US006791287B2

(12) United States Patent
Taniwa et al.

(10) Patent No.: US 6,791,287 B2
(45) Date of Patent: Sep. 14, 2004

(54) DEFLECTION YOKE DEVICE

(75) Inventors: Kenichiro Taniwa, Takatsuki (JP); Katsuyo Iwasaki, Nishinomiya (JP); Takahiro Yoshinaga, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 90 days.

(21) Appl. No.: 10/240,576

(22) PCT Filed: Jan. 28, 2002

(86) PCT No.: PCT/JP02/00580

§ 371 (c)(1),
(2), (4) Date: Sep. 30, 2002

(87) PCT Pub. No.: WO02/061795

PCT Pub. Date: Aug. 8, 2002

(65) Prior Publication Data

US 2003/0173913 A1 Sep. 18, 2003

(30) Foreign Application Priority Data

Jan. 29, 2001 (JP) ..... 2001-019553

(51) Int. Cl.[7] ..... G09G 1/28
(52) U.S. Cl. ..... 315/368.28; 315/370
(58) Field of Search ..... 315/368.25–368.28, 315/364, 370, 368.11, 399, 400; 313/412, 413, 409, 421, 428, 431, 442, 440; 335/210, 212, 213

(56) References Cited

U.S. PATENT DOCUMENTS 4,267,541 A * 5/1981 Narikiyo ..... 335/212
4,788,470 A * 11/1988 Kohzuki et al. ..... 313/440
4,818,919 A * 4/1989 Kobayashi et al. ..... 315/371
5,523,658 A * 6/1996 Fukuma et al. ..... 315/368.19
5,770,932 A 6/1998 Nakane ..... 313/412
5,811,922 A * 9/1998 Yi ..... 313/440
6,285,141 B1 * 9/2001 Osawa ..... 315/368.28
6,384,546 B2 * 5/2002 Nakajima ..... 315/371

FOREIGN PATENT DOCUMENTS

| | | |
|---|---|---|
| JP | 7-326304 | 12/1995 |
| JP | 10-50237 | 2/1998 |
| JP | 4-80192 | 7/1998 |
| JP | 11-54067 | 2/1999 |
| JP | 11-213915 | 8/1999 |
| TW | 263592 | 11/1995 |

* cited by examiner

*Primary Examiner*—Don Wong
*Assistant Examiner*—Ephrem Alemu
(74) *Attorney, Agent, or Firm*—Merchant & Gould P.C.

(57) ABSTRACT

A deflection yoke device includes a deflection yoke for deflecting electron beams in horizontal and vertical directions, the electron beams being emitted from an electron gun of a color cathode ray tube; coma correcting coils positioned on an electron gun side of the deflection yoke so as to be opposed to each other in such a manner that the electron beams pass therebetween; and a pair of cores around which the coma correcting coils are wound, wherein a sliding mechanism is further provided for allowing each of the coma correcting coils to be slidable with respect to the corresponding core. Therefore, a misconvergence can be corrected by a simplified configuration without reducing a sensitivity of the coma correcting coils.

3 Claims, 7 Drawing Sheets

DEFLECTION YOKE DEVICE

TECHNICAL FIELD

The present invention relates to a deflection yoke device for use in a color cathode ray tube of a television receiver, a computer display or the like.

BACKGROUND ART

Generally, convergence properties are affected by a shift of a central axis of a deflection yoke device from a central axis of a color cathode ray tube or a so-called deflection yoke tilt such that the central axes cross each other at a certain angle. As a solution to this, the following technique has been disclosed in JP 11 (1999)-54067 A.

As shown in FIG. 8, a deflection yoke device 1 is provided with a deflection yoke 3 having a configuration in which horizontal and vertical deflection coils 2 for detecting electron beams emitted from an electron gun of a color cathode ray tube in a horizontal direction and in a vertical direction, respectively, are positioned on an insulation frame 21. A pair of U-shaped cores 4*a* and 4*b* are positioned on the electron gun side of the deflection yoke 3 so as to be opposed to each other with a path of the electron beams interposed therebetween, and quadrupole coma correcting coils 5*a* and 5*b* are wound around the U-shaped cores 4*a* and 4*b*, respectively. The U-shaped cores 4*a* and 4*b* are slidable in a vertical direction or in a lateral direction by a sliding mechanism (not shown).

According to this configuration, when a central axis shift in a vertical direction between the color cathode ray tube and the deflection yoke 3 causes a $Y_H$ misconvergence as shown in FIG. 9A, the pair of U-shaped cores 4*a* and 4*b* provided with the coma correcting coils 5*a* and 5*b* are slid in a vertical direction as shown by an arrow in FIG. 10A. This allows the $Y_H$ misconvergence due to the central axis shift between the color cathode ray tube and the deflection yoke 3 to be corrected without tilting the deflection yoke 3. Further, when a central axis shift in a lateral direction between the color cathode ray tube and the deflection yoke 3 causes a $Y_V$ misconvergence as shown in FIG. 9B, the pair of U-shaped cores 4*a* and 4*b* provided with the coma correcting coils 5*a* and 5*b* are slid in a horizontal direction as shown by an arrow in FIG. 10B. This allows the $Y_V$ misconvergence due to the central axis shift between the color cathode ray tube and the deflection yoke 3 to be corrected without tilting the deflection yoke 3.

However, in order to correct the misconvergence, the above-mentioned configuration requires a space or sliding mechanisms for allowing the U-shaped cores 4*a* and 4*b* to be slidable in a vertical direction or in a lateral direction from positions shown by solid lines to positions shown by dashed lines as shown in FIGS. 10A and 10B. Consequently, there is a possibility that a distance from the electron beams to each end of the U-shaped cores 4*a* and 4*b* might increase undesirably, which causes a reduction of sensitivity (efficiency) of the coma correcting coils 5*a* and 5*b*. Further, it is necessary to employ a mechanical component for allowing the U-shaped cores 4*a* and 4*b* to be slidable, which results in a complicated configuration.

DISCLOSURE OF THE INVENTION

Therefore, with the foregoing in mind, it is an object of the present invention to provide a deflection yoke device that can correct a misconvergence with a simplified configuration without reducing a sensitivity of coma correcting coils.

The deflection yoke device of the present invention includes: a deflection yoke for deflecting electron beams in a horizontal direction and in a vertical direction, the electron beams being emitted from an electron gun of a color cathode ray tube; coma correcting coils positioned on an electron gun side of the deflection yoke so as to be opposed to each other in such a manner that the electron beams pass therebetween; and a pair of cores around which the coma correcting coils are wound. In the deflection yoke device, a sliding mechanism further is provided for sliding each of the coma correcting coils with respect to the corresponding core.

According to the above-mentioned configuration, ends of the cores can be positioned in contact with or in close proximity to a neck portion of the color cathode ray tube, thereby preventing a reduction of sensitivity of the coma correcting coils. Further, it is required for the configuration only to make the coma correcting coils slidable with respect to the cores, which eliminates the need for an additional mechanical component for sliding the cores as in the prior art.

BEST MODE FOR CARRYING OUT THE INVENTION

Hereinafter, the present invention will be described by way of embodiments with reference to the appended drawings.

First Embodiment

Figure 1:
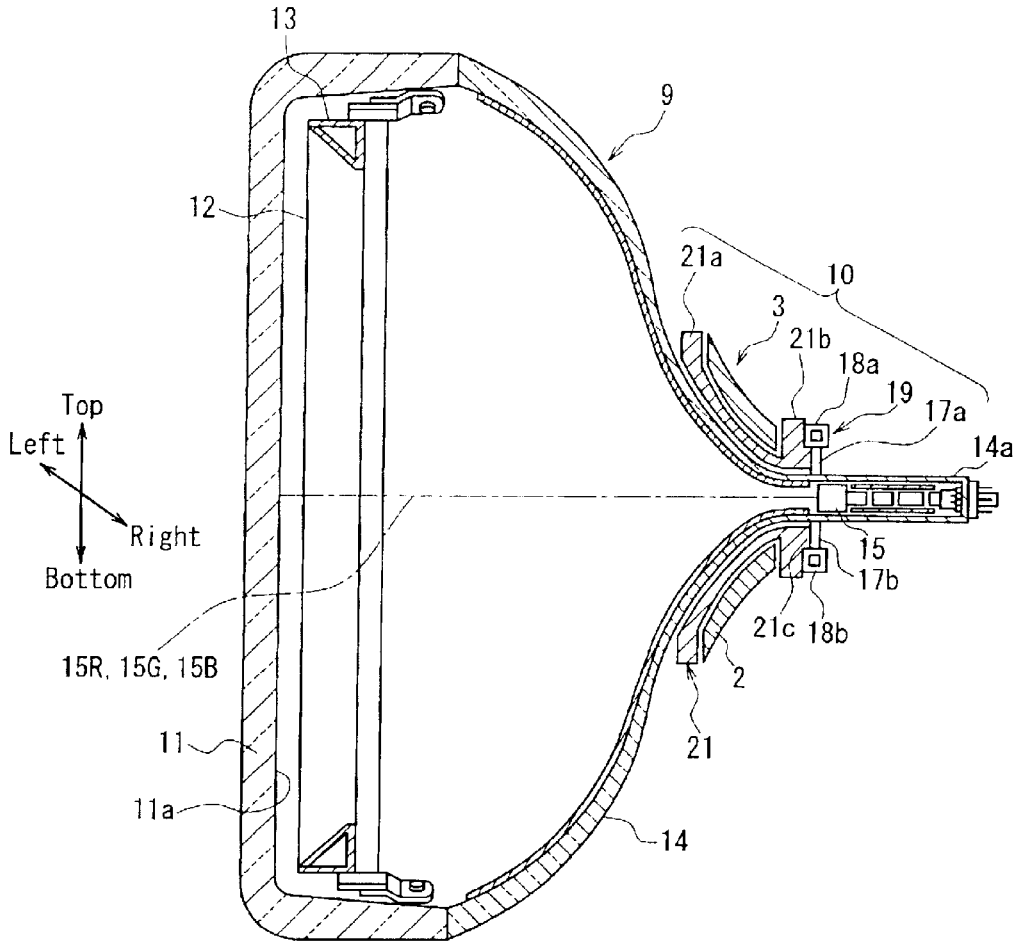
FIG. 1 is a cross-sectional view of a color cathode ray tube provided with a deflection yoke device according to a first embodiment of the present invention.

FIG. 1 shows a color cathode ray tube 9 provided with a deflection yoke device 10 according to an embodiment of the present invention. The color cathode ray tube 9 is composed of a panel 11 having a phosphor screen 11*a*, a frame 13 having a shadow mask 12 located at a position opposed to the phosphor screen 11*a*, a neck tube portion 14*a* having an electron gun 15 thereinside, and a funnel portion 14 establishing a connection between the neck tube portion 14*a* and the panel 11. For convenience in the following description, as shown in the figures, a horizontal direction (actually, a direction orthogonal to a sheet surface of the figure) is referred to as a lateral direction and a top-to-bottom direction is referred to as a vertical direction.

Figure 2:
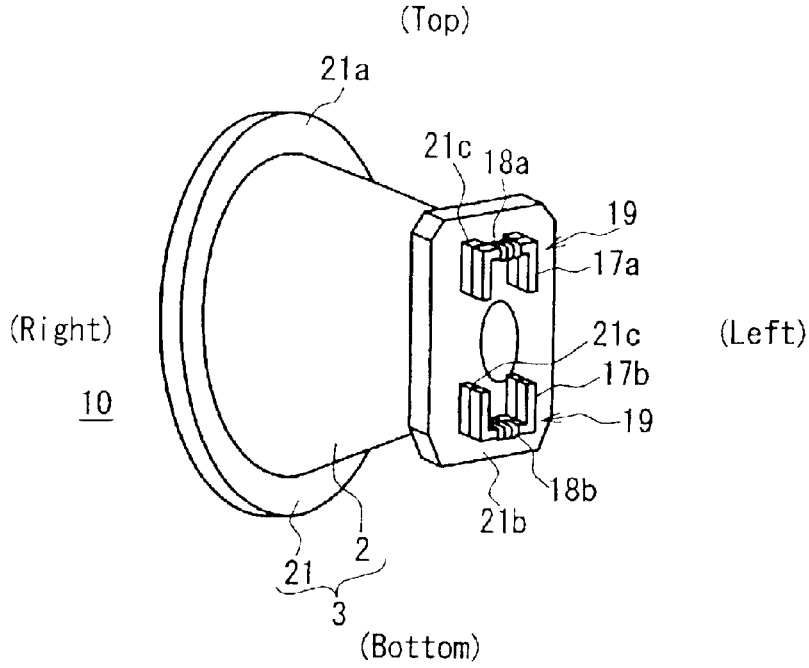
FIG. 2 is a perspective side view of the deflection yoke device.
Figure 3:
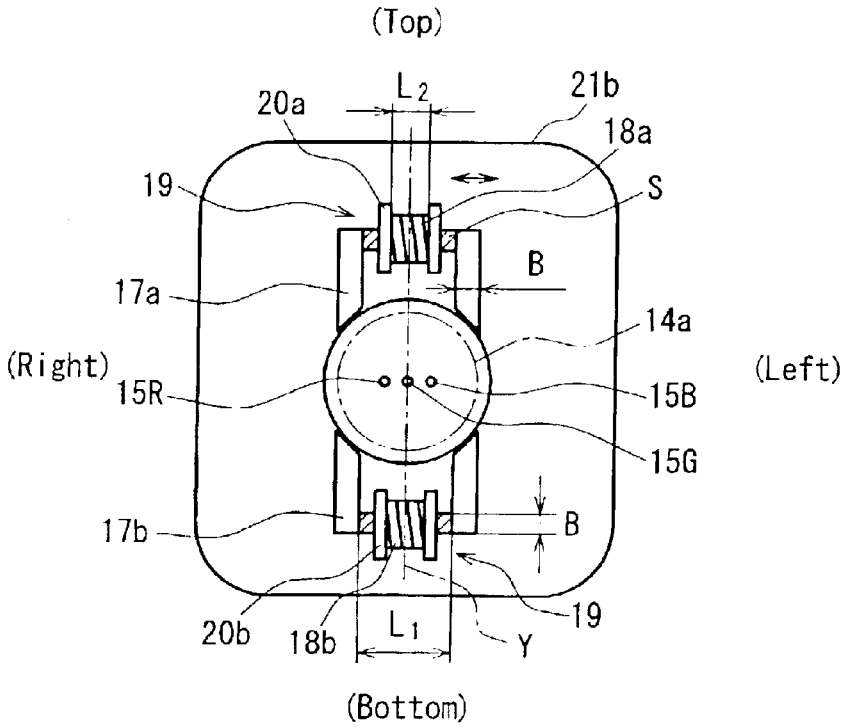
FIG. 3 is a rear elevation of the deflection yoke device.

The deflection yoke device 10 is provided on an outer surface of the funnel portion 14 for deflecting electron beams 15R, 15G and 15B emitted from the electron gun 15. As shown in FIGS. 2 and 3, the deflection yoke device 10 is provided with a deflection yoke 3, a pair of U-shaped cores 17*a* and 17*b* and sliding mechanisms 19. The deflection yoke 3 has horizontal and vertical deflection coils 2 provided in a pair, respectively, for generating a magnetic field so as to deflect the electron beams 15R, 15G and 15B emitted from the electron gun 15 in horizontal and vertical directions. The U-shaped cores 17*a* and 17*b* are positioned to be opposed to each other on the electron gun side of the deflection yoke 3 with the electron beams 15R, 15G and 15B interposed therebetween, and further, quadrupole coma correcting coils 18*a* and 18*b* are wound around the U-shaped cores at bottoms of the U shapes. The sliding mechanisms 19 allow the coma correcting coils 18*a* and 18*b* to be slidable with respect to the U-shaped cores 17*a* and 17*b*. The coma correcting coils 18*a* and 18*b* are connected in series to the vertical deflection coil 2.

An insulation frame 21 of the deflection yoke 3 includes a wall 21*a* having a shape of a conical frustum on which the horizontal and vertical deflection coils 2 are provided, and a core attachment plate portion 21*b* positioned on the smaller diameter side of the wall 21*a*, the core attachment plate portion 21*b* being integrated with the wall 21*a*. On the core attachment plate portion 21*b*, a projected portion 21*c* is formed. The core attachment plate portion 21*b* is not necessarily integrated with the wall 21*a*, and it may be provided separately from the insulation frame 21 as an individual member.

Figure 9A:
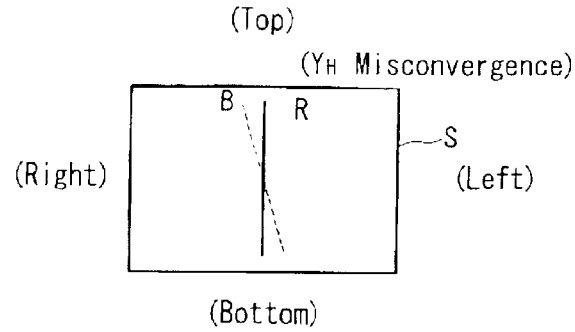
FIGS. 9A to 9D are views showing misconvergence patterns.
Figure 9B:
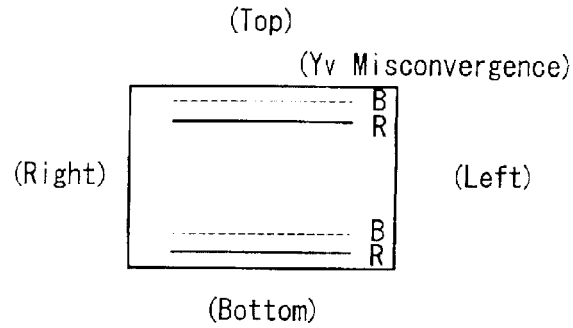

The U-shaped cores 17*a* and 17*b* are fixed to the projected portion 21*c* of the core attachment plate portion 21*b*. The coma correcting coils 18*a* and 18*b* are wound around tubular-shaped bobbins 20*a* and 20*b* as shown in FIG. 3. The bobbins 20*a* and 20*b* have inside diameters larger than outside diameters of the U-shaped cores 17*a* and 17*b*, so that the bobbins 20*a* and 20*b* can slide in a lateral direction on intermediate portions S of the U-shaped cores 17*a* and 17*b*, thus defining the sliding mechanisms 19. Thus, this configuration enables the correction of a VG crossed misconvergence shown in FIG. 9C due to a rotational shift of the deflection yoke 3 with respect to the color cathode ray tube in addition to the correction of the $Y_V$ misconvergence shown in FIG. 9B, which is described in the above "BACKGROUND ART". After the misconvergences are corrected, the bobbins 20*a* and 20*b* are fixed to the U-shaped cores 17*a* and 17*b* using a hot-melt adhesive.

It is preferable that the inside diameters of the bobbins 20*a* and 20*b*, and the outside diameters of the U-shaped cores 17*a* and 17*b* are set to dimensions such that their positions relative to each other can be fixed by friction. More specifically, it is preferable that the U-shaped cores are fitted in the bobbins in such a manner that positions of the bobbins 20*a* and 20*b* do not shift unless an external force larger than a certain set level is applied thereto. As an example of dimensions for realizing this, when the inside diameters of the bobbins 20*a* and 20*b* are set to 6 mm minus 0 to 0.2 mm and the outside diameters of the U-shaped cores 17*a* and 17*b* are set to 6 mm minus 0.05 to 0 mm, a good result can be obtained.

Before fixing the bobbins 20*a* and 20*b* to the U-shaped cores 17*a* and 17*b* using an adhesive, the bobbins 20*a* and 20*b* are fixed temporarily to the midsections of the U-shaped cores 17*a* and 17*b*. When a correction is required, positions of the bobbins 20*a* and 20*b* are corrected manually. Finally, the bobbins 20*a* and 20*b* are fixed to the U-shaped cores 17*a* and 17*b* using the adhesive irrespective of whether the position correction was carried out.

A length L1 of the intermediate portion S of each of the U-shaped cores 17*a* and 17*b* is larger than a coil-wound length L2 of each of the bobbins 20*a* and 20*b*. Further, the U-shaped cores 17*a* and 17*b* are arranged so that the ends thereof are in contact with or in close proximity to an outer circumferential surface of the neck tube portion 14*a*.

Functions and effects of the deflection yoke device configured as mentioned above will be described below.

Figure 4:
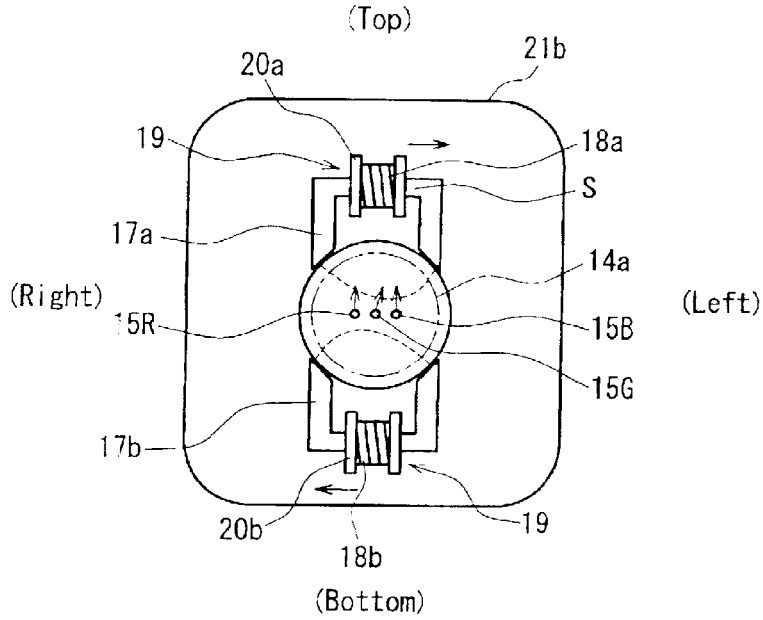
FIG. 4 is a view showing magnetic lines of force after sliding of bobbins of quadrupole coma correcting coils in the deflection yoke device.

Since the deflection yoke device 10 of the present invention is provided with the sliding mechanisms 19 that allow the coma correcting coils 18*a* and 18*b* to be slidable in a lateral direction on the U-shaped cores 17*a* and 17*b*, magnetic fields generated from both the ends of the U-shaped cores 17*a* and 17*b* can be asymmetric as shown in FIG. 4. Accordingly, as mentioned above, the VG crossed misconvergence shown in FIG. 9C also can be corrected in addition to the correction of the $Y_V$ misconvergence shown in FIG. 9B. Consequently, an optimum image can be obtained.

The magnetic fields generated from both the ends of the U-shaped core 17*a* (17*b*) become asymmetric for the following reasons. The first reason is that there is a difference between respective distances from the coma correcting coil 18*a* (18*b*) to left and right ends of the core 17*a* (17*b*), which causes a difference in strength between the magnetic fields generated from the left and right ends of the core 17*a* (17*b*). The second reason is that since a position of the coma correcting coil 18*a* (18*b*) shifts from the center of the U-shaped core 17*a* (17*b*) to the left or the right, the electron beams are affected asymmetrically by a radiational magnetic field that is applied directly from the coma correcting coil 18*a* (18*b*) itself.

Figure 10A:
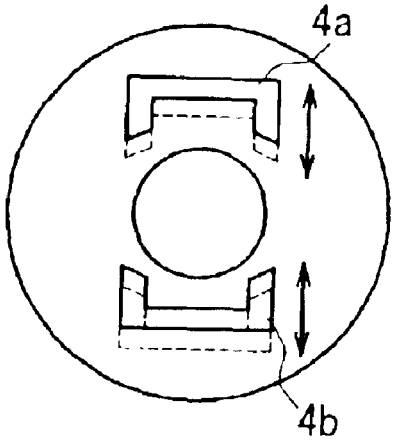
FIGS. 10A and 10B are rear elevations showing operations of the conventional deflection yoke device.
Figure 10B:
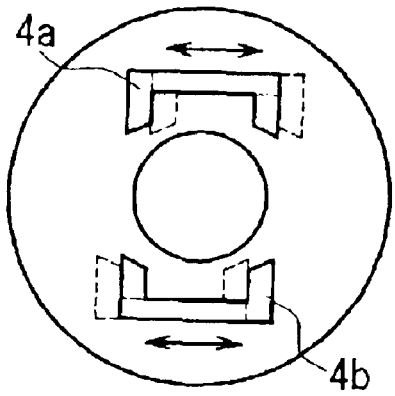

In the deflection yoke device 10 of the present invention, the U-shaped cores 17*a* and 17*b* are fixed to the core attachment plate portion 21*b* with both the ends being in contact with or in close proximity to the neck tube portion 14*a*, and positions of the ends of the U-shaped cores 17*a* and 17*b* of the present invention do not change, unlike the prior art shown in FIGS. 10A and 10B, in which positions of ends of U-shaped cores 4*a* and 4*b* change with respect to a neck portion. Accordingly, the present invention can avoid a reduction of sensitivity of the coma correcting coils 18*a* and 18*b* due to the change in the positions of both the ends of the U-shaped cores.

Further, since the deflection yoke device 10 of the present invention is configured only by making the bobbins 20*a* and 20*b* slidable in a lateral direction with respect to the U-shaped cores 17*a* and 17*b*, it does not require any additional mechanical component that the prior art requires for making the U-shaped cores 4*a* and 4*b* slidable. Consequently, the configuration can be simplified as compared with the prior art, and further a space for attaching the U-shaped cores 17*a* and 17*b* to the core attachment plate portion 21*b* can be reduced.

The following is an explanation of experiments for confirming effects with regard to a correction amount of the VG crossed misconvergence that occurred when the yoke deflection device 10 of the present invention shown in FIGS. 2 and 3 was fitted to the color cathode ray tube as shown in FIG. 1, and the bobbins 20*a* and 20*b* were slid in a lateral direction to the U-shaped cores 17*a* and 17*b*.

As the color cathode ray tube 9, a 46 (cm) cathode ray tube for a computer monitor was employed. Each of the U-shaped cores 17*a* and 17*b* had a width B of 6 mm, and the intermediate portion S thereof had a length L1 of 20 mm. Each of the bobbins 20*a* and 20*b* had a coil-wound length L2 of 14 mm and a winding number of 80 turns.

Figure 9C:
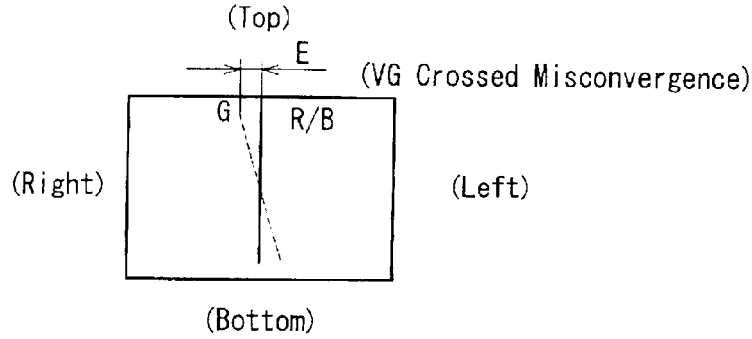

The above-mentioned correction amount is defined as a distance E shown in FIG. 9C that corresponds to a lateral movement of the electron beams in a peripheral portion of the panel, which is caused by a slide displacement of the bobbins 20*a* and 20*b* from the center Y either to the left or the right as shown in FIG. 3.

The experimental results show that when the bobbins 20*a* and 20*b* were slid from the center Y either to the left or the right by a distance of 20% of the coil winding length L2 in the deflection yoke device of the present invention, there was a change in the distance E by 0.1 mm.

The sliding mechanisms 19 of the present embodiment are described regarding the case where the bobbins 20*a* and 20*b* are configured to be slidable in a lateral direction with respect to the intermediate portions S of the U-shaped cores 17*a* and 17*b*. However, the configuration is not limited to this and the same effects can be obtained in another configuration. For example, the following configuration may be employed. Tubular-shaped bobbins around which coma correcting coils are wound are provided on the U-shaped cores 17*a* and 17*b* at each leg portion thereof. The inside diameters of the bobbins are made larger than the outside diameters of the U-shaped cores 17*a* and 17*b* so that the bobbins are slidable in a vertical direction on the leg portions of the U-shaped cores 17*a* and 17*b*. This configuration can realize the correction of the $Y_H$ misconvergence shown in FIG. 9A due to a central axis shift in a vertical direction between the color cathode ray tube and the deflection yoke 3.

Second Embodiment

A deflection yoke device of a second embodiment will be described with reference to FIG. 5. The first embodiment exemplifies a configuration in which each of the cores 17*a* and 17*b* is formed in a U shape, and the pair of the cores 17*a* and 17*b* are arranged vertically. The configuration is not limited thereto. More specifically, the shape and the position of the core can be changed as required depending on misconvergence patterns.

Figure 5:
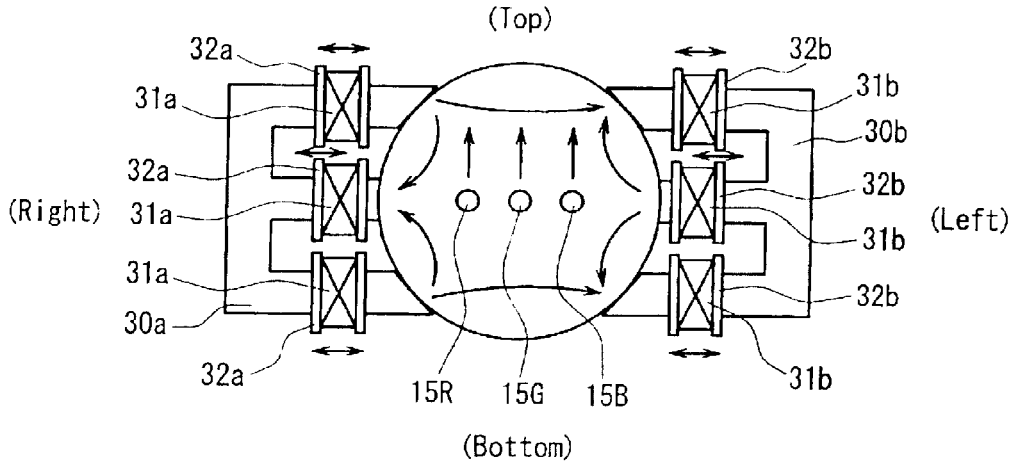
FIG. 5 is a rear elevation of a deflection yoke device according to a second embodiment of the present invention.
Figure 9D:
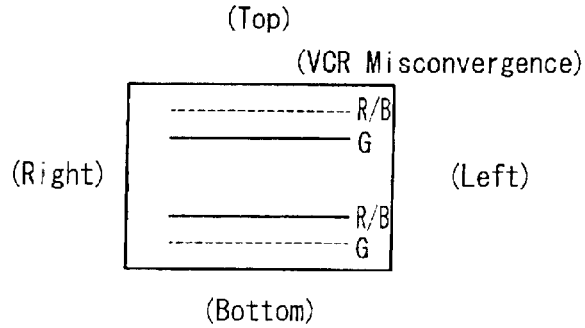

For example, a configuration shown in FIG. 5 is employed so as to correct a VCR misconvergence shown in FIG. 9D due to a central axis shift in a vertical direction between the color cathode ray tube and the deflection yoke 3. In this configuration, a pair of E-shaped cores 30*a* and 30*b* are arranged laterally, and bobbins 32*a* and 32*b* around which coma correcting coils 31*a* and 31*b* are wound, respectively, are fitted to the E-shaped cores 30*a* and 30*b*, respectively, at each leg portion thereof. By sliding the bobbins 32*a* and 32*b* in a lateral direction, the VCR misconvergence can be reduced.

Third Embodiment

Figure 6:
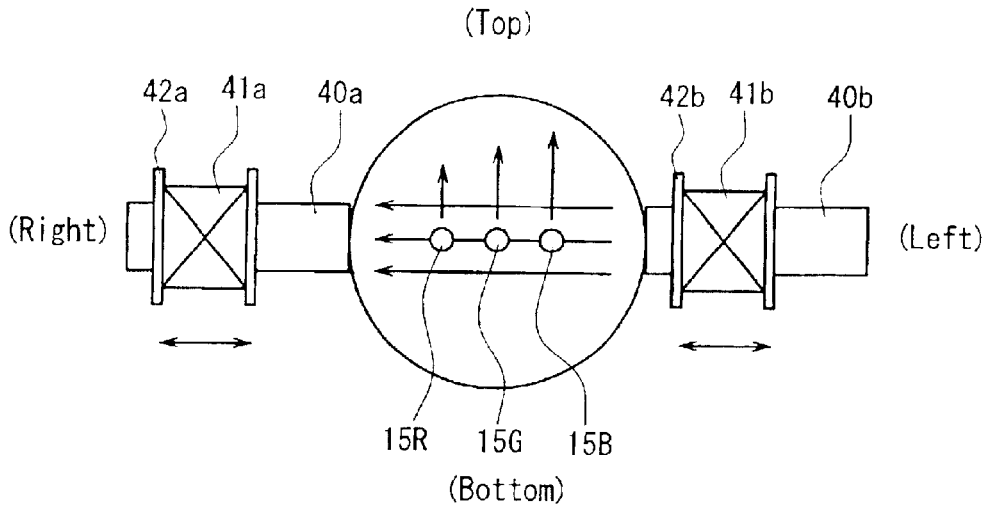
FIG. 6 is a rear elevation of a deflection yoke device according to a third embodiment of the present invention.

A deflection yoke device of a third embodiment will be described with reference to FIG. 6. A configuration of the present embodiment is employed for correcting the $Y_V$ misconvergence shown in FIG. 9B. As shown in FIG. 6, a pair of I-shaped cores 40*a* and 40*b* are arranged laterally, and bobbins 42*a* and 42*b* around which coma correcting coils 41*a* and 41*b* are wound, respectively, are fitted to the I-shaped cores 40*a* and 40*b*, respectively, at each rod-shaped portion thereof. By sliding the bobbins 42*a* and 42*b* in a lateral direction, the $Y_V$ misconvergence can be reduced.

Fourth Embodiment

Figure 7A:
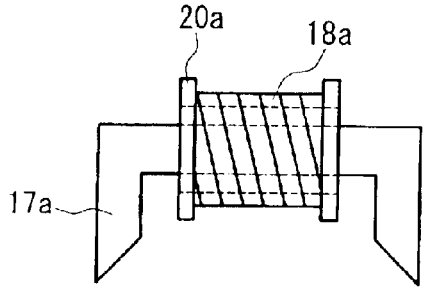
FIG. 7A is a rear elevation of a part of a deflection yoke device according to a fourth embodiment of the present invention.
Figure 7B:
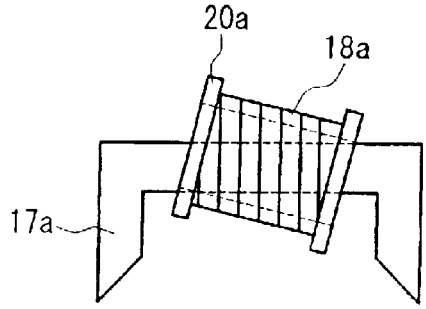
FIG. 7B is a rear elevation showing an operation of the same deflection yoke device.
Figure 8:
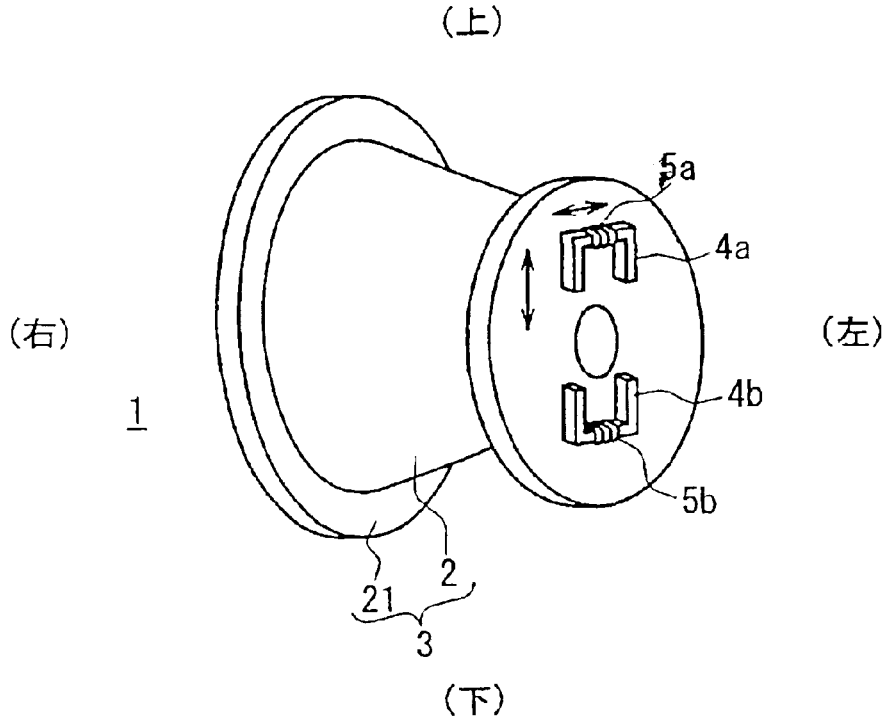
FIG. 8 PRIOR ART
FIG. 8 is a perspective side view of a conventional deflection yoke device.

A part of the deflection yoke device of the third embodiment is shown in FIGS. 7A and 7B. In the present embodiment, the inside diameter of the bobbin 20*a* (shown by dashed lines) is set to be larger sufficiently than the outside diameter of the U-shaped core 17*a* (shown by dashed lines) as shown in FIG. 7A. Therefore, the coma correcting coil 18*a* is not only slidable, that is, movable parallel, but also movable rotatably with respect to the U-shaped core 17*a* as shown in FIG. 7B. More specifically, the coma correcting coil 18*a* is slidable in an axis direction of the U-shaped core 17*a*, and also is movable rotatably in such a manner that its angle with respect to the axis of the U-shaped core 17*a* varies. This configuration causes a magnetic field to be asymmetric. For example, when the coma correcting coil 18*a* is positioned at a center of the U-shaped core 17*a* and then only moves rotatably, it is possible to obtain an asymmetric influence of a radiational magnetic field generated from the coma correcting coil 18*a*.

In order to obtain a good result by the above-mentioned rotational movement, dimensions should be set so that the U-shaped core 17*a*, that is, the coma correcting coil 18*a* is movable rotatably in a range from 5° to 45°. As an example of the dimension for realizing this, the inside diameter of the bobbin 20*a* may be 13 mm and the outside diameter of the U-shaped core 17*a* may be 6 mm.

According to the present embodiment, since there is a large space between the U-shaped core 17*a* and the bobbin 20*a*, a position of the coma correcting coil 18*a* is not determined until the coma correcting coil 18*a* is fixed using an adhesive. Therefore, it is preferable to appropriately specify a height of the projected portion 21*c* from the core attachment plate portion 21*b* shown in FIG. 2 so that the bobbin 20*a* is clamped between the core attachment plate portion 21*b* and the U-shaped core 17*a* with an appropriate force. This allows the coma correcting coil 18*a* to be fixed temporarily and also facilitates the position correction.

The coma correcting coils 18*a*, 18*b*, 31*a*, 31*b*, 41*a* and 41*b* described in the above-mentioned embodiments are connected in series to the vertical deflection coil 2. However, those coils are not necessarily connected thereto. For example, in the case where those coils are connected in series to the horizontal deflection coil, the misconvergence can be corrected as well.

INDUSTRIAL APPLICABILITY

According to the present invention, it is possible to provide a deflection yoke device that can correct a misconvergence with a simplified configuration without reducing a sensitivity of a coma correcting coil. Therefore, when the deflection yoke device is fitted to a cathode ray tube, an optimum image can be obtained.

What is claimed is:

1. A deflection yoke device comprising:

a deflection yoke for deflecting electron beams in horizontal and vertical directions, the electron beams being emitted from an electron gun of a color cathode ray tube;

coma correcting coils positioned on an electron gun side of the deflection yoke so as to be opposed to each other in such a manner that the electron beams pass therebetween; and a pair of cores around which the coma correcting coils are wound, wherein each of the cores is formed in a shape of U, the comma correcting coils are wound around respective tubular shaped bobbins and are positioned at bottom portions or both leg portions of the U-shaped cores, and the inside diameters of the bobbins and the outside diameters of the U-shaped cores are set to dimensions such that their positions relative to each other can be fixed by friction allowing each of the bobbins to be slidable with respect to the corresponding core and to maintain the relative positions of the bobbins with only the friction force.

2. The deflection yoke device according to claim 1, wherein the pair of cores are arranged in a vertical direction or in a lateral direction with respect to the color cathode ray tube.

3. A deflection yoke device comprising:

a deflection yoke for deflecting electron beams in horizontal and vertical directions, the electron beams being emitted from an electron gun of a color cathode ray tube;

coma correcting coils positioned on an electron gun side of the deflection yoke so as to be opposed to each other in such a manner that the electron beams pass therebetween; and a pair of cores around which the coma correcting coils are wound, wherein each of the cores is formed in a shape of U, the coma correcting coils are positioned at bottom portions or both leg portions of the U-shaped cores, and a sliding mechanism is provided for allowing each of the coma correcting coils to be slidable in an axis direction of the core, and to be movable rotatably in a direction such that an angle of the coma correcting coil with respect to the axis of the core varies.

* * * * *